US009145682B1

(12) United States Patent
Tanaka et al.

(10) Patent No.: US 9,145,682 B1
(45) Date of Patent: Sep. 29, 2015

(54) COLUMN STRUCTURE

(71) Applicant: Hitachi Metals Techno, Ltd., Koto-ku, Tokyo (JP)

(72) Inventors: Hidenori Tanaka, Tokyo (JP); Hideaki Takahashi, Tokyo (JP)

(73) Assignee: Hitachi Metals Techno, Ltd., Tokyo (JP)

( * ) Notice: Subject to any disclaimer, the term of this patent is extended or adjusted under 35 U.S.C. 154(b) by 0 days.

(21) Appl. No.: 14/345,950

(22) PCT Filed: Mar. 17, 2014

(86) PCT No.: PCT/JP2014/057083

§ 371 (c)(1),
(2) Date: Apr. 8, 2014

(51) Int. Cl.
*E04C 3/32* (2006.01)
*E04B 1/41* (2006.01)

(52) U.S. Cl.
CPC ..... *E04C 3/32* (2013.01); *E04B 1/4157* (2013.01); *E04B 2103/06* (2013.01)

(58) Field of Classification Search
CPC ..... E04C 3/32; E04C 2/08; E04B 1/4157; E04B 2103/06; E02D 27/42; E04H 12/2292; E04H 12/2276; E04H 12/2261; E04H 12/10; E04H 12/085; E04H 12/2269; E04H 17/10; F03D 11/04; F03D 11/045; F05B 2240/912
USPC ..... 52/170, 651.01, 651.07, 296, 297, 831
See application file for complete search history.

(56) References Cited

U.S. PATENT DOCUMENTS 2,610,708 A * 9/1952 Shannon ..... 52/296
4,965,974 A * 10/1990 LeBow ..... 52/301
5,063,719 A * 11/1991 Matsuo et al. ..... 52/296
5,410,847 A * 5/1995 Okawa et al. ..... 52/272
5,426,267 A * 6/1995 Underhill et al. ..... 181/210
5,505,033 A * 4/1996 Matsuo et al. ..... 52/296
5,678,382 A * 10/1997 Naito ..... 52/745.21
6,438,904 B1 * 8/2002 Anzai et al. ..... 52/167.1
8,336,267 B2 * 12/2012 Montague et al. ..... 52/295
8,955,283 B2 * 2/2015 Takagi et al. ..... 52/649.2
2003/0196393 A1 * 10/2003 Bowman et al. ..... 52/295
2005/0120666 A1 * 6/2005 Alyea et al. ..... 52/698
2006/0048471 A1 * 3/2006 Lee ..... 52/296
2007/0209314 A1 * 9/2007 Vaughn ..... 52/720.1
2009/0272053 A1 * 11/2009 Dent ..... 52/296
2009/0279959 A1 * 11/2009 Bakos ..... 405/231
2010/0146890 A1 * 6/2010 Kristensen ..... 52/297
2011/0154758 A1 * 6/2011 Reyneveld ..... 52/296
2014/0069046 A1 * 3/2014 Cai et al. ..... 52/651.01
2014/0318033 A1 * 10/2014 Coordes, Thomas ..... 52/40

FOREIGN PATENT DOCUMENTS

CN 203452266 U * 2/2014
CN 203531147 U * 4/2014
JP H04-153427 5/1992

(Continued)

*Primary Examiner* — Joshua J Michener
*Assistant Examiner* — Keith Minter
(74) *Attorney, Agent, or Firm* — Solaris Intellectual Property Group, PLLC

(57) ABSTRACT

In a column structure, a base member is fixed onto a foundation by mortar, serving as a fixing member. First and second anchor bolts are employed as anchor members for fixing the base member. A steel column, serving as a column member in which flanges are integrally formed at both sides in a width direction of a web, is joined to the upper side of the base member. A shear resistance member is provided to a lower portion of the web, so as to be buried at least in the mortar. The shear strength of the column structure is raised by the shear resistance member.

9 Claims, 9 Drawing Sheets

(56) References Cited

FOREIGN PATENT DOCUMENTS

| | | | | |
|---|---|---|---|---|
| JP | 05346038 A | * | 12/1993 | ..... E04B 1/24 |
| JP | 06010410 A | * | 1/1994 | ..... E04B 1/24 |
| JP | 2001-288815 | | 10/2001 | |
| JP | 2002-322737 A | | 11/2002 | |
| JP | 2008-280787 | | 11/2008 | |

* cited by examiner

COLUMN STRUCTURE

TECHNICAL FIELD

The present invention relates to a column structure in which a column member is joined to an upper side of a base member that is fixed to a foundation.

BACKGROUND ART

A column set-up construction method is disclosed in Japanese Patent Application Laid-Open (JP-A) No. 2002-322737. In the column set-up construction method, a plinth (base plate) is provided on the face of a foundation, with mortar interposed therebetween, and the plinth is fixed to anchor bolts that are buried in the foundation. A column is joined to the plinth by welding. The column is formed from H-section steel that has flanges provided at both sides in a width direction of a web.

In the above column set-up construction method, although the plinth is fixed to the foundation by the anchor bolts, with the mortar interposed therebetween, a structure is formed such that shear stress transmitted from the column set-up to the foundation is borne by frictional force acting at the interface between the plinth and the mortar. There is accordingly room for improvement regarding the shear strength of the column set-up structure.

DISCLOSURE OF INVENTION

Technical Subject

In consideration of the above circumstance, a subject of the present invention is to obtain a column structure that enables the shear strength to be raised.

Solution to Problem

A column structure of a first aspect of the present invention is placed on a foundation and the column structure including: a column member having a web and flanges that are integrally provided at both sides, in a width direction, of the web; a base member having an upper side that is joined to the column member; an anchor member including a lower end side that is fixed to the foundation and an upper end side to which the base member is fixed; a fixing member that is provided between the foundation and the base member; and a shear resistance member that is provided to a lower portion of the web so as to extend at least as far as into the fixing member, and that increases the shear resistance of the column member at least with respect to the fixing member.

A column structure of a second aspect of the present invention is the column structure of the first aspect, wherein the shear resistance member is integrally formed to a lower portion of the web with the length direction of the shear resistance member oriented in the width direction of the web.

A column structure of a third aspect of the present invention is the column structure of the first aspect, wherein the shear resistance member is formed by a member that is joined to a lower portion of the web, and that is buried at least in the fixing member.

A column structure of a fourth aspect of the present invention is the column structure of the first aspect, wherein the shear resistance member is formed by a plate that is joined to a lower portion of the web, and that has a length direction oriented in the width direction of the flanges.

A column structure of a fifth aspect of the present invention is the column structure of any one of the first aspect to the fourth aspect, wherein the base member is configured by a first base member having an upper side to which one of the flanges is joined, and a second base member that is provided at a separation to the first base member and that has an upper side to which the other of the flanges is joined; and the shear resistance member is provided between the first base member and the second base member.

A column structure of a sixth aspect of the present invention is the column structure of any one of the first aspect to the fourth aspect, wherein the shear resistance member is buried only in the fixing member.

A column structure of a seventh aspect of the present invention is the column structure of any one of the first aspect to the fourth aspect, wherein: the shear resistance member is buried in the fixing member and in the foundation.

A column structure of an eighth aspect of the present invention is the column structure of either the sixth aspect or the seventh aspect, wherein indentation and protrusion portions are provided on an upper face portion of the foundation, and the fixing member is provided so as to cover the indentation and protrusion portions of the upper face portion of the foundation.

A column structure of a ninth aspect of the present invention is the column structure of the first aspect, wherein a pass-through portion is provided so as to pierce through from a front face to a back face of the base member at a location where the web is provided, and the shear resistance member is provided so as to go through the pass-through portion and extend as far as at least into the fixing member.

Advantageous Effects of Invention

In the column structure of the first aspect of the present invention, the column member has the web and the flanges that are integrally provided at both sides, in a width direction, of the web, is joined to an upper side of the base member. The base member is fixed to the upper end side of the anchor member whose lower end side is fixed to the foundation. The fixing member is provided between the foundation and the base member.

The shear resistance member is provided to the lower portion of the web of the column member. The shear resistance member extends at least as far as into the fixing member, and increases the shear resistance of the column member with respect to the fixing member. Thus shear stress transmitted from the column member to the foundation through the base member and the fixing member is efficiently suppressed, thereby enabling the shear strength of the column structure to be raised.

According to the column structure of the second aspect of the present invention, the shear resistance member is integrally formed to the lower portion of the web with the length direction of the shear resistance member oriented in the width direction of the web. Thus the shear resistance of the column structure with respect to the fixing member is more increased in the width direction of the flanges that intersect with the width direction of the web than the shear resistance of the column structure in the width direction of the web. This thereby enables the shear strength of the column structure in the width direction of the flanges to be raised.

According to the column structure of the third aspect of the present invention, the shear resistance member is formed by a member that is joined to the lower portion of the web, and that is buried at least in the fixing member. This thereby enables the shear strength of the column structure to be raised by a simple configuration in which the member buried in the fixing member is joined to the lower portion of the web.

According to the column structure of the fourth aspect of the present invention, the shear resistance member is formed by the plate that is joined to the lower portion of the web. The plate is provided with its length direction oriented in the width direction of the flanges. Thus the shear resistance of the column structure with respect to the fixing member is increased in the width direction of the web that intersects with the width direction of the flanges. This thereby enables the shear strength of the column structure to be raised in the width direction of the web.

According to the column structure of the fifth aspect of the present invention, the base member is configured by the first base member to which one flange is joined and the second base member to which the other flange is joined. The first base member and the second base member are also provided separated from each other, thereby enabling the shear resistance member to easily pass through in the separated portion, and to extend as far as into at least the fixing member. An amount of material equivalent to the separated portion is thereby saved in the base member.

According to the column structure of the sixth aspect of the present invention, the shear resistance member is buried only in the fixing member, and this thereby enables the shear resistance member to be simply buried in the fixing member by merely providing the fixing member between the foundation and the base member.

According to the column structure of the seventh aspect of the present invention, the shear resistance member is buried as far as into the foundation, such that the shear resistance of the column member is further increased with respect to the foundation and the fixing member, thereby enabling the shear strength to be further increased.

According to the column structure of the eighth aspect of the present invention, the indentation and protrusion portions are provided on the upper face portion of the foundation, and the fixing member is provided so as to cover the indentation and protrusion portions, thereby efficiently suppressing shear stress from occurring at the interface between the foundation and the fixing member. This thereby enables the shear strength of the column structure to be raised even further.

According to the column structure of the ninth aspect of the present invention, a pass-through portion is provided in the base member, thereby enabling the shear resistance member to easily go through the pass-through portion so as to extend as far as into at least the fixing member.

BEST MODE FOR CARRYING OUT THE INVENTION

First Exemplary Embodiment

Figure 1:
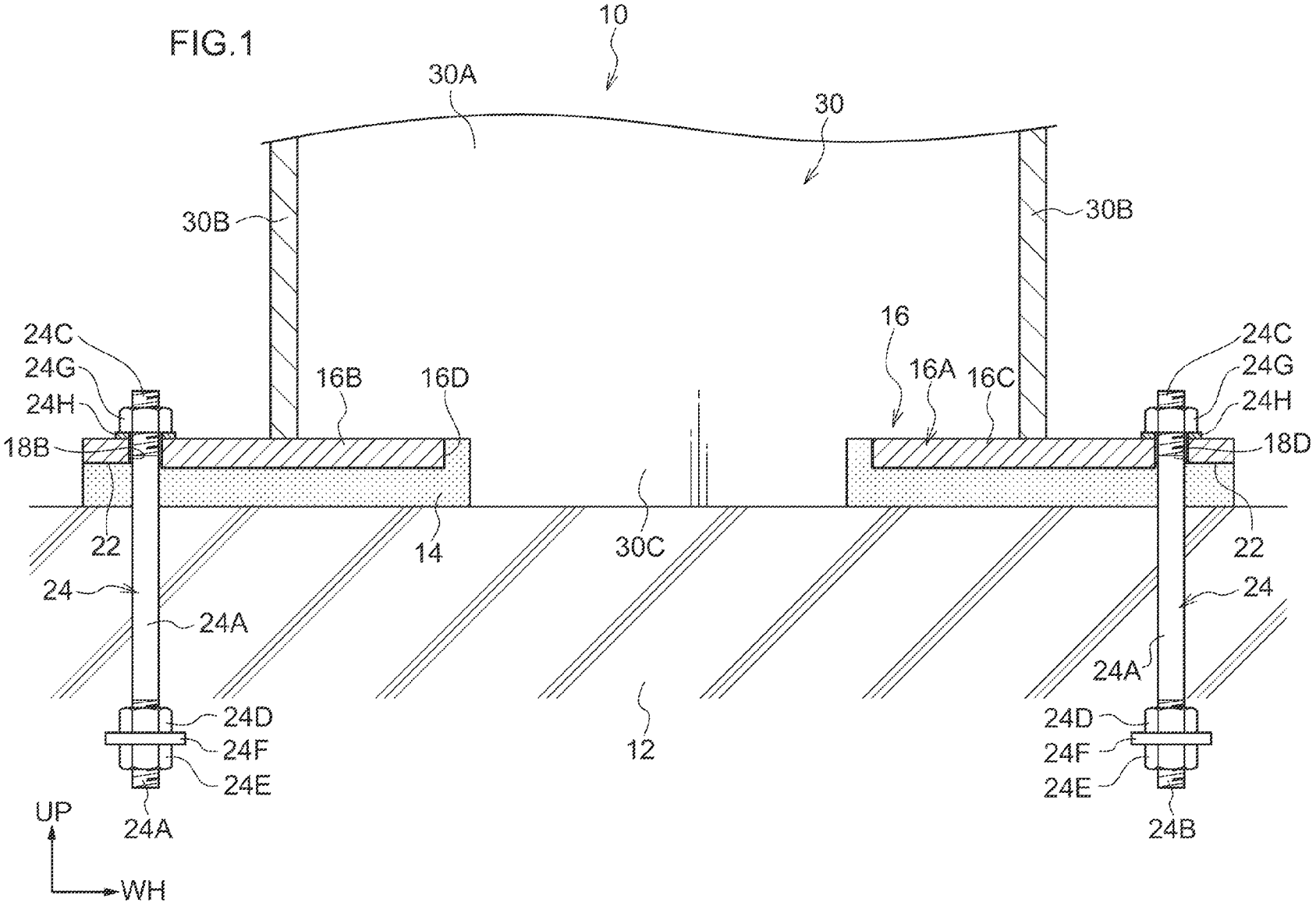
FIG. 1 is a cross-section view of a column structure according to a first exemplary embodiment of the present invention, as viewed from a width direction of a flange (taken along line A-A of FIG. 2).
Figure 2:
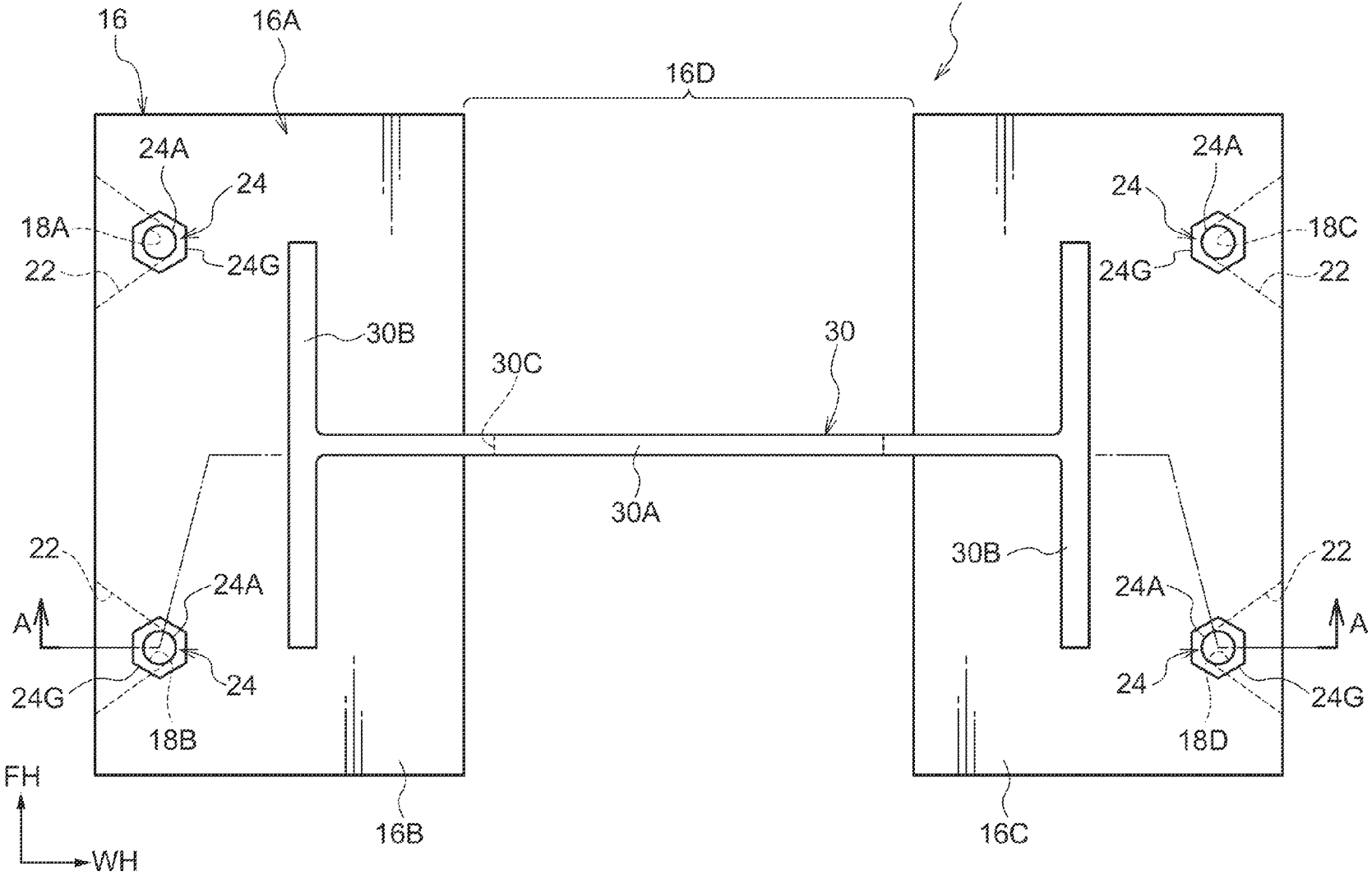
FIG. 2 is a plan view of a column structure according to the first exemplary embodiment.

Explanation follows regarding a column structure according to a first exemplary embodiment of the present invention, with reference to FIG. 1 and FIG. 2. Note that in the present exemplary embodiment an H-section steel frame column (H-section steel column) is employed as a column member, and in the drawings the arrow WH direction indicates a width direction of a web of the column member, and the arrow FH direction indicates a width direction of flanges of the column member as appropriate. The arrow UP direction indicates upwards.

Column Structure Configuration

As illustrated in FIG. 1, the column structure 10 according to the present exemplary embodiment is placed on a foundation 12. The foundation 12 is, for example, concrete, and the upper face of the foundation 12 is formed as flat plane shape horizontally. The concrete may, for example, be formed with main components of cement, sand and gravel. In cases in which strengthening of the foundation 12 is required, a foundation beam layout, not illustrated in the drawings, is provided within the foundation 12. The foundation 12 has a higher strength than that of mortar 14.

The mortar 14 is provided as a fixing member on the upper surface of the foundation 12. The mortar 14 is formed, for example, in a rectangular shape in plan view. The mortar 14 is, for example, formed with main components of cement and sand.

As illustrated in FIG. 1 and FIG. 2, a base member 16 is fixed to an upper face of the mortar 14. The base member 16 is provided with a base plate 16A, as a base body. The mortar 14 is disposed across the entire lower side of the base plate 16A. More precisely, the base member 16 in the present exemplary embodiment is split into two, and is equipped with a first base plate 16B serving as a first base member, and a second base plate 16C serving as a second base member. In FIG. 1 and FIG. 2, the first base plate 16B illustrated on the left hand side is configured in a rectangular flat plate shape, with its length direction along the arrow FH direction, and its short direction along the arrow WH direction. The second base plate 16C illustrated on the right hand side is configured in the same rectangular flat plate shape as the first base plate 16B. The first base plate 16B and the second base plate 16C are separated from each other in the horizontal direction. The separated portion configures a region 16D. The first base plate 16B and the second base plate 16C are, for example, formed from a metal material, such as SN490B hot-rolled structural steel plate for construction according to Japanese Industrial Standard (JIS) specification G3136, or cast steel.

Two first fixing holes 18A and 18B are provided along the arrow FH direction at one end portion that is at outer side in the arrow WH direction of the left hand side first base plate 16B as shown in FIG. 1 and FIG. 2. The first fixing holes 18A and 18B are formed as circular shaped through holes each having the same diameter in plan view.

Two second fixing holes 18C and 18D are provided along the arrow FH direction at one end portion that is at outer side in the arrow WH direction of the right hand side second base plate 16C. The second fixing holes 18C and 18D are formed as circular shaped through holes each having the same diameter in plan view and the diameter of the second fixing holes 18C and 18D are the same as that of the first fixing holes 18A and 18B.

The positions of the center axes of the first fixing holes 18A and 18B are aligned with each other along the arrow FH direction. The positions of the center axes of the second fixing holes 18C and 18D are aligned with each other along the arrow FH direction. In addition, the positions of the center axes of the first fixing hole 18A and the second fixing hole 18C are aligned with each other along the arrow WH direction. The positions of the center axes of the first fixing hole 18B and the second fixing hole 18D are aligned with each other along the arrow WH direction.

Consequently, the first base plate 16B has two holes, the first fixing holes 18A and 18B, and the second base plate 16C has two holes, the second fixing holes 18C and 18D, such that the base plate 16A is provided with a total of four fixing holes.

As illustrated in FIG. 1 and FIG. 2, indented portions 22 are formed at the lower faces of the first base plate 16B and the second base plate 16C at the periphery of each of the four fixing holes, such as the first fixing hole 18A. The upper face (bottom face of the indented portions 22) of each of the indented portions 22 has a flat plane shape disposed in the horizontal direction. The indented portions 22 are formed in substantially triangular shapes in plan view, gradually widening on progression toward the outer peripheral side of the first base plate 16B or the second base plate 16C, respectively. The indented portions 22 open to the outside of the outer periphery of the first base plate 16B and second base plate 16C. Within the peripheral faces of the indented portions 22 in the vertical direction, the peripheral faces located toward the central area of the first base plate 16B are configured in the same plane as the inside faces of the first fixing holes 18A and 18B. Similarly, within the peripheral faces of the indented portions 22 in the vertical direction, the peripheral faces located toward the central area of the second base plate 16C are configured in the same plane as the inside faces of the second fixing holes 18C and 18D. The mortar 14 fills the whole of the indented portions 22, and the first base plate 16B and the second base plate 16C are fixed by the mortar 14.

At the first fixing portions of the base member 16, a first anchor member is fixed to the foundation 12 at each of the first fixing portions of the base member 16, and a second anchor member is fixed to the foundation 12 at each of the second fixing portions. The first anchor members are each provided with a first anchor bolt (anchor lock) 24 and the second anchor members are each provided with a second anchor bolt (anchor lock) 24.

The first anchor bolts 24 and the second anchor bolts 24 are each equipped with a circular rod shaped anchor body 24A, with the anchor body 24A disposed with its axial direction along the up-down direction. Except for an upper end portion 24C, most of the anchor body 24A, including a lower end portion 24B, pierces through the mortar 14 and is buried and fixed in the foundation 12. A male thread is provided to the lower end portion 24B of the anchor body 24A, and two nuts, a nut 24D and a nut 24E, are provided screwed onto at the top and bottom directions of the male thread. A disk shaped fixing plate 24F configuring an anchor portion is interposed between the nuts 24D and 24E, so as to project further out than the outside of the shaft diameter of the anchor body 24A. The fixing plate 24F is fixed by tightening of the nuts 24D and 24E. The nuts 24D, 24E and the fixing plate 24F are buried in the foundation 12, and are configured to prevent the first anchor bolt 24 and the second anchor bolt 24 from being pulled out.

In the first anchor bolts 24, the upper end portions 24C of the anchor bodies 24A are respectively configured so as to pierce through and project out from the first fixing holes 18A and 18B of the first base plate 16B. A male thread is provided to each of the upper end portions 24C, and nuts 24G for fixing the first base plate 16B are screwed onto the male thread, respectively. A circular flat shaped washer 24H is interposed between the first base plate 16B and the nut 24G.

In the second anchor bolts 24, the upper end portions 24C of the anchor bodies 24A are respectively configured so as to pierce through and project out from the second fixing holes 18C and 18D of the second base plate 16C. A male thread is provided to each of the upper end portions 24C, and nuts 24G for fixing the second base plate 16C are screwed onto the male thread, respectively. A circular flat shaped washer 24H is interposed between the second base plate 16C and the nut 24G.

In the present exemplary embodiment, the first anchor bolts 24 and the second anchor bolts 24 are formed with the same diameters and the same axial direction lengths as each other. More precisely, as the first anchor bolt 24 and the second anchor bolt 24, anchor bolts formed, for example, from a carbon steel material having a tensile strength such as 400 $N/mm^2$, or 490 $N/mm^2$ as defined by JIS specification G3138 may be employed. An anchor bolt formed from stainless steel having a tensile strength of 520 $N/mm^2$ as defined by JIS specification G4321 may also be employed therefor.

At a center portion on the upper face of the base plate 16A, or in other words on the upper faces of the first base plate 16B and the second base plate 16C, a steel column 30 is provided as a column member, with its length direction extending in the up-down direction. A lower end of the steel column 30, except for a portion thereof, is joined, for example by arc welding, to the upper faces of the first base plate 16B and the second base plate 16C.

The steel column 30 is, in the present exemplary embodiment, formed from H-section steel, and includes a web 30A and a pair of flanges 30B that are integrally provided at both sides in the width direction of the web 30A. The web 30A of the steel column 30 is formed in an elongated rectangular flat plate shape with its width direction running along the arrow WH direction and its length direction running along the arrow UP direction. The pair of flanges 30B is each formed in an elongated rectangular flat plate shape with their width directions running along the arrow FH direction and with their length directions running along the arrow UP direction. The both ends of the web 30A are integrally joined to central portions in the width direction of the flanges 30B.

The lower end of one of the flanges 30B of the steel column 30, and a portion of the lower end of the web 30A on the side integrally joined to this flange 30B, are joined to the upper face of the first base plate 16B. The lower end of the other of the flanges 30B of the steel column 30, and a portion of the lower end of the web 30A on the side integrally joined to the other flange 30B, are joined to the upper face of the second base plate 16C. The steel column 30 is, for example formed from a rolled structural steel for use in construction as defined by JIS specification G3136, a rolled steel for use in welded structures as defined by JIS specification G3106, or a rolled steel for use in general purpose structures as defined by JIS specification G3101.

The column structure 10 according to the present exemplary embodiment is equipped with a shear resistance member 30C provided to a lower portion of the web 30A and reaching into the mortar 14. More precisely, the shear resistance member 30C is integrally formed to a lower central portion of the web 30A, between the first base plate 16B and the second base plate 16C (in the region 16D). A central portion at the lower end of the web 30A extends (projects) out downward to configure the shear resistance member 30C. The shear resistance member 30C is formed in a rectangular flat plate shape in side view, having a length direction aligned with the width direction of the web 30A (the arrow WH direction), and a short direction aligned with the up-down direction (the arrow UP direction). It is, for example, possible to simply form the shear resistance member 30C by removing both end portions of the lower portion of the web 30A and the lower portions of the flanges 30B using a cutting torch.

As long as the shear resistance member 30C is buried into the mortar 14, the shear resistance member 30C may extend as far as partway through the thickness of mortar 14, or may make contact with the upper face of the foundation 12. For example, when the thickness of the mortar 14 is set at from 30 mm to 50 mm, the length of the shear resistance member 30C in the arrow UP direction is set as a length within the range of the sum of the thickness of the mortar 14 and the thickness of the base member 16. In cases in which the shear resistance member 30C makes contact with the upper face of the foundation 12, a portion of the steel column 30 makes direct contact with, and is supported by, the upper face of the foundation 12.

Note that, normally there are plural of the column structures 10 provided in a building. Although not illustrated in the drawings, footing beams span across between lower end portions of the steel columns 30 of adjacent column structures 10, so as to arrange the major footing beam layout.

Operation and Advantageous Effects of the First Exemplary Embodiment

In the column structure 10 of the present exemplary embodiment, as illustrated in FIG. 1 and FIG. 2, the steel column 30 that has the flanges 30B integrally provided at the both sides in the width direction of the web 30A is joined to the upper side of the base member 16. The base member 16 is fixed to the upper end sides of the first anchor bolt 24 and the second anchor bolt 24 whose lower end sides are fixed in the foundation 12. The mortar 14 is provided as a fixing member between the foundation 12 and the base member 16.

The shear resistance member 30C is provided to the lower portion of the web 30A of the steel column 30. The shear resistance member 30C reaches as far as into the mortar 14, and is retained by the mortar 14, particularly in the horizontal direction (the shear resistance member 30C has an overhang into the mortar 14), thereby increasing the shear resistance of the steel column 30 with respect to the mortar 14. Shear stress that is transmitted from the steel column 30, through the base member 16 and the mortar 14, to the foundation 12 is accordingly efficiently suppressed, thereby enabling the shear resistance of the column structure 10 to be raised. In other words, it is possible to raise the shear resistance of the column structure 10.

Moreover, in the column structure 10 according to the present exemplary embodiment, as illustrated in FIG. 1, the shear resistance member 30C is integrally formed to the lower portion of the web 30A, and the shear resistance member 30C is provided with its length direction aligned with the width direction of the web 30A. The shear resistance of the steel column 30 with respect to the mortar 14 is accordingly more increased along the width direction of the flanges 30B that intersects with the width direction of the web 30A than along the width direction of the web 30A. This thereby enables the shear resistance of the column structure 10 to be increased in the width direction of the flanges 30B.

Moreover, in the column structure 10 according to the present exemplary embodiment, as illustrated in FIG. 1 and FIG. 2, the base member 16 is configured by the first base member and the second base member. The first base member is the first base plate 16B to which one of the flanges 30B is joined. The second base member is the second base plate 16C to which the other of the flanges 30B is joined. The first base plate 16B and the second base plate 16C are disposed separated from each other by the amount of the region 16D, and this enables the shear resistance member 30C to be simply provided so as to extend as far as into the mortar 14 by passing through this separated portion. Additionally, the material equivalent to the separated portion (the portion of the region 16D) is saved in the base member 16.

Moreover, in the column structure 10 according to the present exemplary embodiment, as illustrated in FIG. 1 and FIG. 2, the shear resistance member 30C is only buried into the mortar 14. As a construction sequence, first the first base plate 16B is fixed to the upper end portions of the first anchor bolts 24 that are fixed into the foundation 12, then similarly, the second base plate 16C is fixed to the second anchor bolts 24 that are fixed into the foundation 12. The steel column 30 is then joined to the upper side of the first base plate 16B and the second base plate 16C. A gap is formed between the upper face of the foundation 12, and the first base plate 16B and the second base plate 16C, for forming the mortar 14. The shear resistance member 30C provided to the lower portion of the web 30A is disposed in this gap. The mortar 14 is supplied into the gap, and the column structure 10 is finished when the mortar 14 has hardened. This thereby enables the shear resistance member 30C to be simply buried in the mortar 14 by merely providing the mortar 14 between the foundation 12 and the base member 16.

Note that although the above shear resistance member 30C is rectangular shaped in side view, the present exemplary embodiment is not limited to this shape. For example, the shear resistance member 30C may be formed in a trapezoidal shape (including an inverted trapezoidal shape) in side view, or the shear resistance member 30C may be formed as plural tooth shapes or the like which are formed and arrayed along the width direction of the web 30A at locations to project out downward from the lower end of the web 30A. Namely, the shear resistance member 30C may be any shape as long as it enables shear stress acting in the horizontal direction to be suppressed.

Second Exemplary Embodiment

Figure 3:
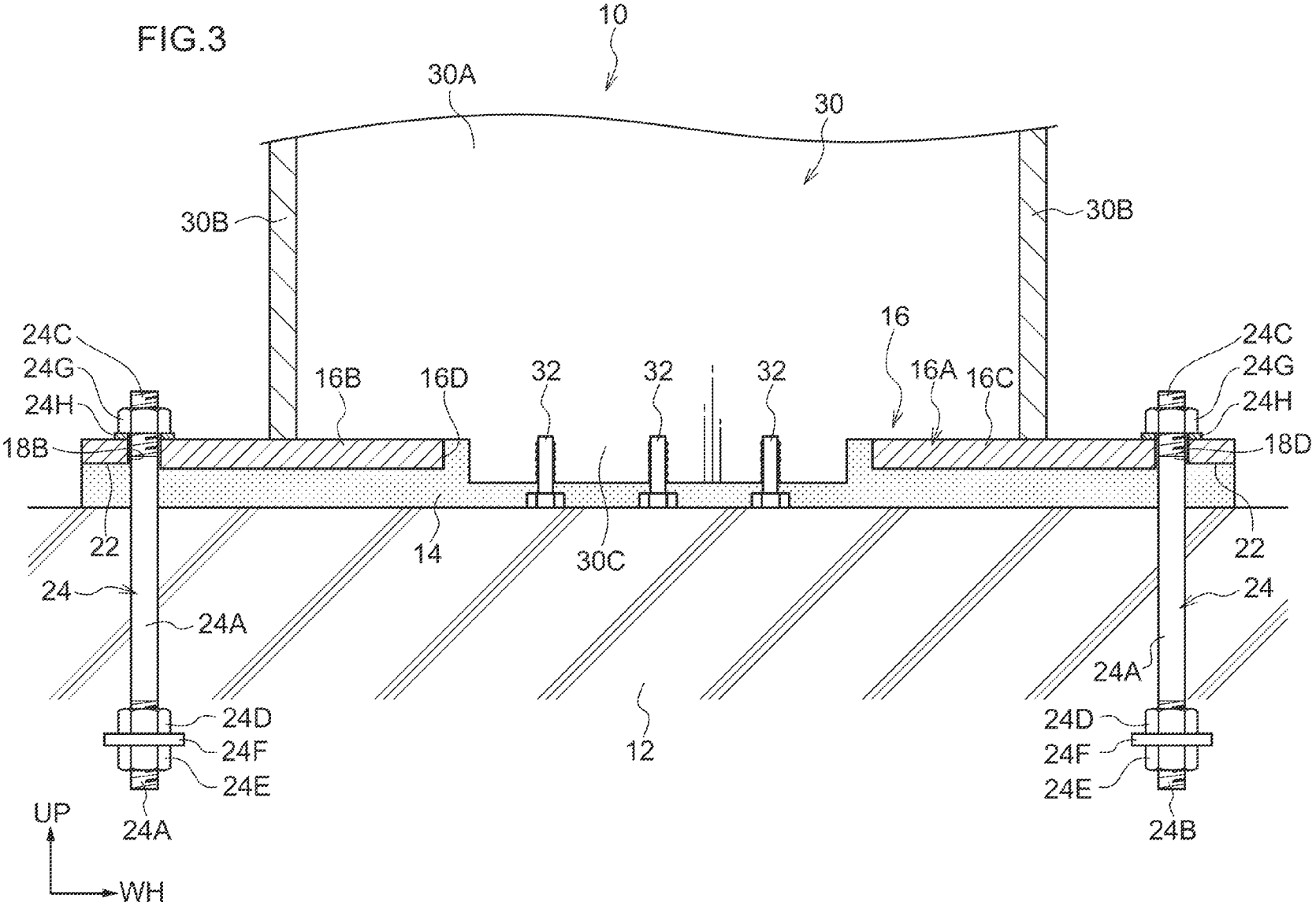
FIG. 3 is a cross-section of a column structure according to a second exemplary embodiment (taken along line B-B of FIG. 4), corresponding to FIG. 1.
Figure 4:
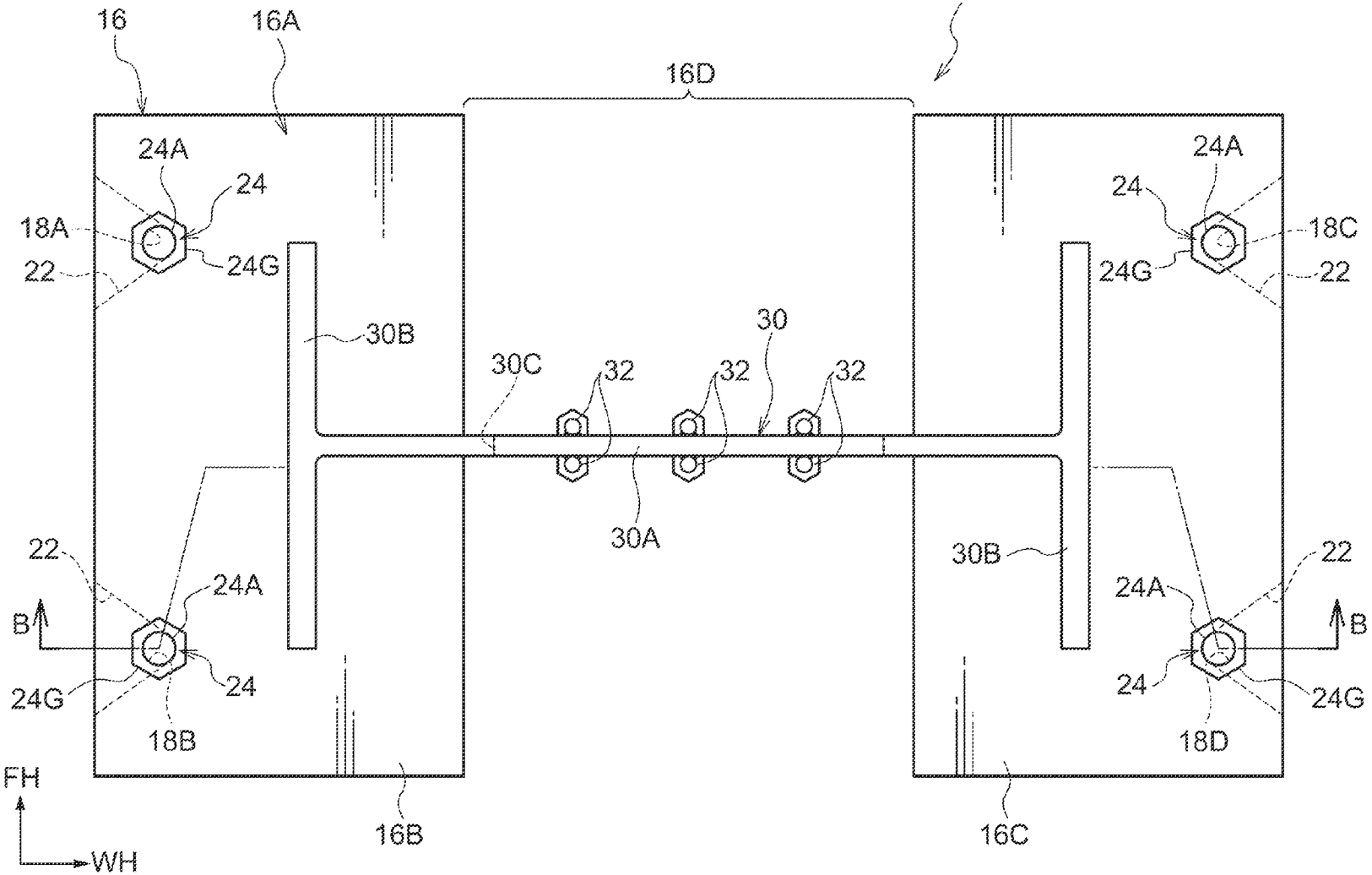
FIG. 4 is a plan view of a column structure according to the second exemplary embodiment.

Explanation next follows regarding a column structure according to a second exemplary embodiment of the present invention, with reference to FIG. 3 and FIG. 4. Note that in the present exemplary embodiment, as well as in subsequently described exemplary embodiments, configuration that is the same as configuration of the column structure 10 according to the first exemplary embodiment is appended with the same reference numerals, and repetition of explanation of such configurations is omitted.

Column Structure Configuration

As illustrated in FIG. 3 and FIG. 4, the column structure 10 according to the present exemplary embodiment is provided with a shear resistance member 30C that is slightly shorter in downward length than the shear resistance member 30C of the column structure 10 according to the first exemplary embodiment, and with shear resistance members 32 provided to the shear resistance member 30C.

More precisely, in the present exemplary embodiment, the shear resistance members 32 are formed by stud bolts that have axial directions aligned in the up-down direction. One end portion at the upper side of each of the stud bolts is joined by welding to side faces of the shear resistance member 30C, or by welding from the shear resistance members 30C across to the web 30A. Male threads are provided at the other end portion on the lower side of the stud bolts, and nuts, not numbered in the drawings, are screwed onto these other end portions. The other end portions of the stud bolts and the nuts are buried in the mortar 14, and the nuts function to prevent pulling out from the mortar 14. In the present exemplary embodiment, three stud bolts are placed at a fixed spacing along the width direction of the web 30A such that the three stud bolts are placed on one surface in the flanges 30B width direction of the shear resistance member 30C, and three more are similarly placed on the other surface thereof. Note that there is no particular limitation to the number and placement spacing of the stud bolts. A bolt head may also be provided at the other end portions of the stud bolts.

Operation and Advantageous Effects of the Second Exemplary Embodiment

In the column structure 10 according to the present exemplary embodiment, as illustrated in FIG. 3 and FIG. 4, the shear resistance members 32 are joined to a lower portion of the web 30A, and are formed by materials that are buried in the mortar 14. This thereby enables the shear strength of the column structure 10 to be raised using a simple configuration in which the lower portion of the web 30A is joined to the members buried in the mortar 14. In addition, in the column structure 10 according to the present exemplary embodiment, the shear resistance members 32 are formed by the stud bolts that are joined to the lower portion of the web 30A. Due to the stud bolts being circular rod shaped, the shear resistance of the steel column 30 is increased with respect to the mortar 14 in all horizontal directions, including both the width direction of the web 30A and in the width direction of the flanges 30B. This thereby enables the shear strength of the column structure 10 to be raised in both the width direction of the web 30A and in the width direction of the flanges 30B.

Moreover, the column structure 10 according to the present exemplary embodiment is provided with both the shear resistance member 30C integrally formed to the lower portion of the web 30A, and with the shear resistance members 32 formed by the stud bolts, thereby enabling the shear strength to be raised further.

Moreover, in the column structure 10 according to the present exemplary embodiment, since existing stud bolts may be employed as the shear resistance members 32, this thereby enables the shear strength to be raised by a simple configuration.

Note that in the column structure 10 according to the present exemplary embodiment, configuration may be made without provision of the shear resistance member 30C integrally formed to the lower portion of the web 30A, and only provided with the shear resistance members 32 formed by the stud bolts by joining the stud bolts directly to the lower portion of the web 30A. The shear resistance members 32 are not limited to stud bolts, and the shear resistance members 32 may be formed from round bar, square bar, rebar, plates with length direction oriented in the arrow UP direction, plates with length direction oriented in the arrow WH direction, etc. These are joined to the lower portion of the web 30A.

Third Exemplary Embodiment

Figure 5:
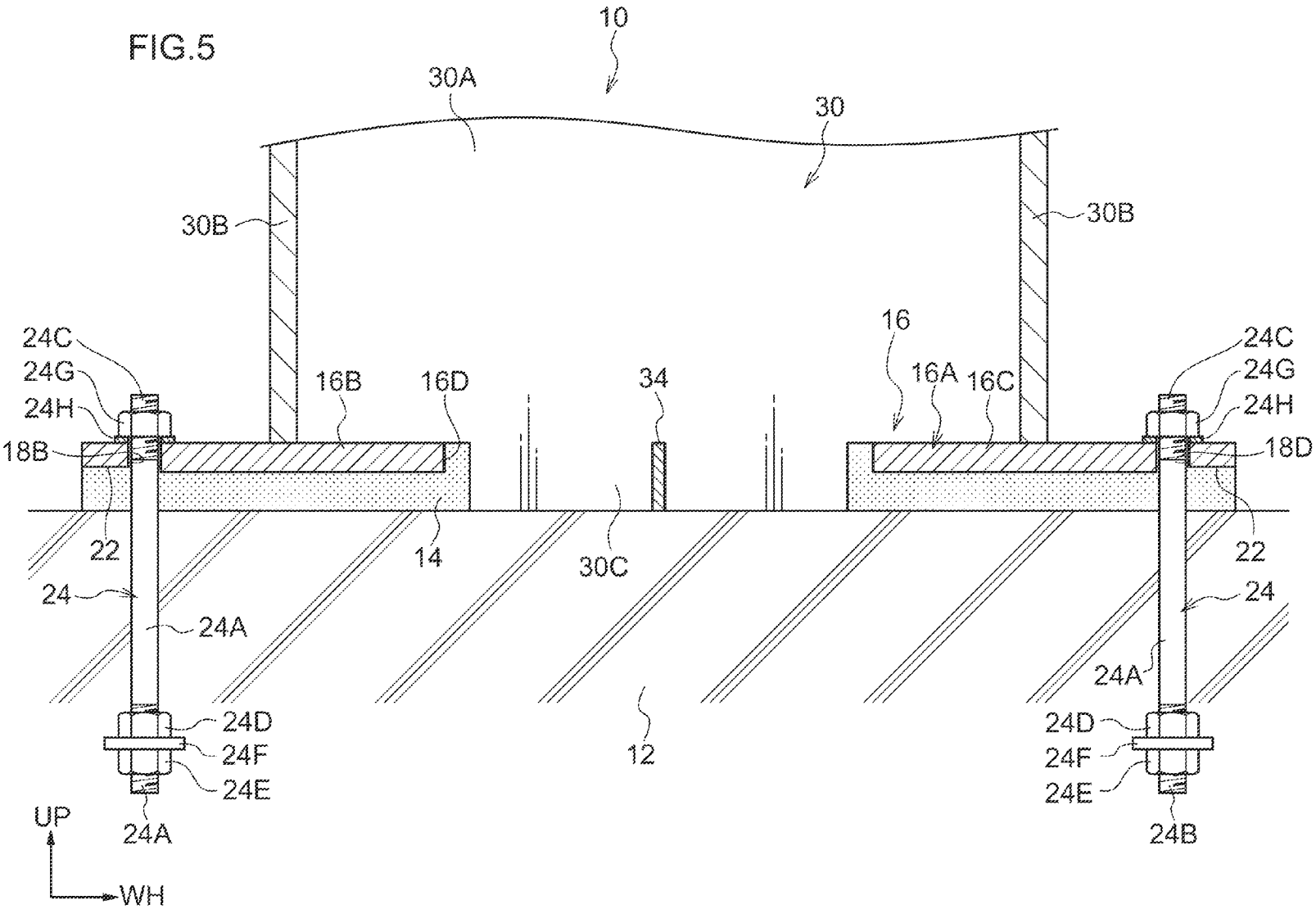
FIG. 5 is a cross-section of a column structure according to a third exemplary embodiment of the present invention (taken along line C-C of FIG. 6), corresponding to FIG. 1.
Figure 6:
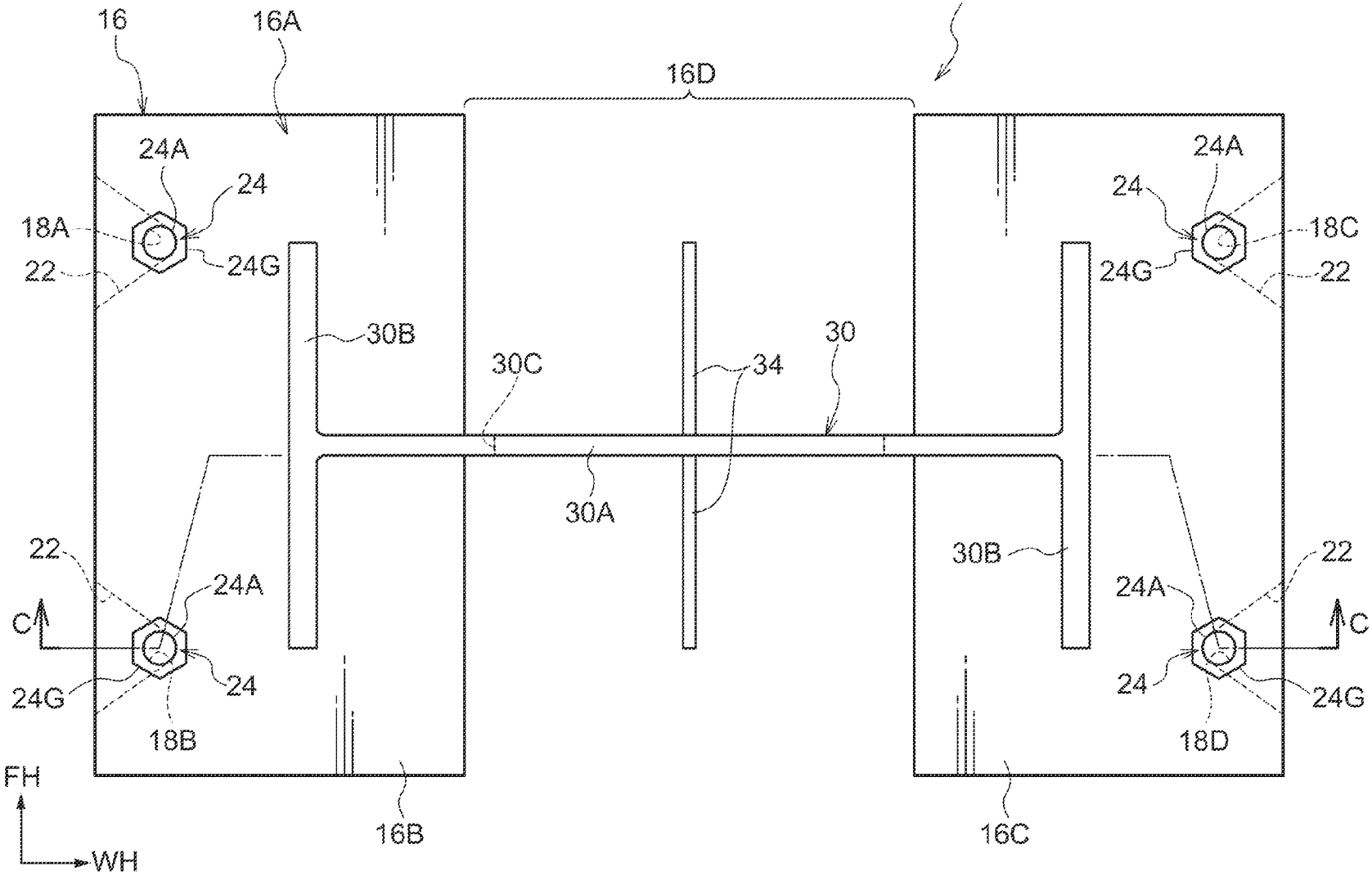
FIG. 6 is a plan view of a column structure according to the third exemplary embodiment.

Explanation next follows regarding a column structure according to a third exemplary embodiment of the present invention, with reference to FIG. 5 and FIG. 6.

Column Structure Configuration

As illustrated in FIG. 5 and FIG. 6, a column structure 10 according to the present exemplary embodiment is provided with the shear resistance member 30C of the column structure 10 according to the first exemplary embodiment, and shear resistance members 34 provided to the shear resistance member 30C.

More precisely, in the present exemplary embodiment, the shear resistance members 34 are formed by a rectangular flat shaped plates provided with a length direction oriented in the width direction of flanges 30B, and with a short direction oriented in the up-down direction. These plates are each respectively joined to the one face and another face in the flange 30B width direction of the shear resistance member 30C by welding at a center portion in the web 30A width direction of the shear resistance member 30C. The shear resistance member 34 is buried into the mortar 14 together with the shear resistance member 30C. The shear resistance member 34 is, for example, formed from a similar material to that of the shear resistance member 30C. The shape of the shear resistance members 34 is not limited to a rectangular shape, and may be varied in a similar manner to the shear resistance member 30C. Moreover, the shear resistance members 34 may have short directions that are inclined with respect to the horizontal direction or the vertical direction. Inclined shear resistance members 34 may, for example, be provided to a lower portion of a steel column 30 that is inclined with respect to the surface of the base member 16.

Operation and Advantageous Effects of the Third Exemplary Embodiment

In the column structure 10 according to the present exemplary embodiment, as illustrated in FIG. 5 and FIG. 6, the shear resistance members 34 are formed by plates that are joined to the lower portion of the web 30A. The plates are provided such that their length directions are oriented in the width direction of the flanges 30B. Therefore the shear resistance of the steel column 30 with respect to the mortar 14 is increased in the width direction of the web 30A that intersects with the width direction of the flanges 30B. This thereby enables the shear strength of the column structure 10 to be raised in the width direction of the web 30A.

The column structure 10 according to the present exemplary embodiment is provided with both the shear resistance member 30C integrally formed to the lower portion of the web 30A and the shear resistance members 34 formed by plates. This thereby enables the shear strength to be raised further.

Moreover, in the column structure 10 according to the present exemplary embodiment, plates of simple structure are employed as the shear resistance members 34, thereby enabling the shear strength to be raised using a simple configuration.

Note that in the column structure 10 according to the present exemplary embodiment, the shear resistance member 34 may be formed by round bar, square bar, rebar, or the like, with length direction oriented in the width direction of the flanges 30B. Round bar, or the like, is joined to a lower portion of the web 30A.

Fourth Exemplary Embodiment

Figure 7:
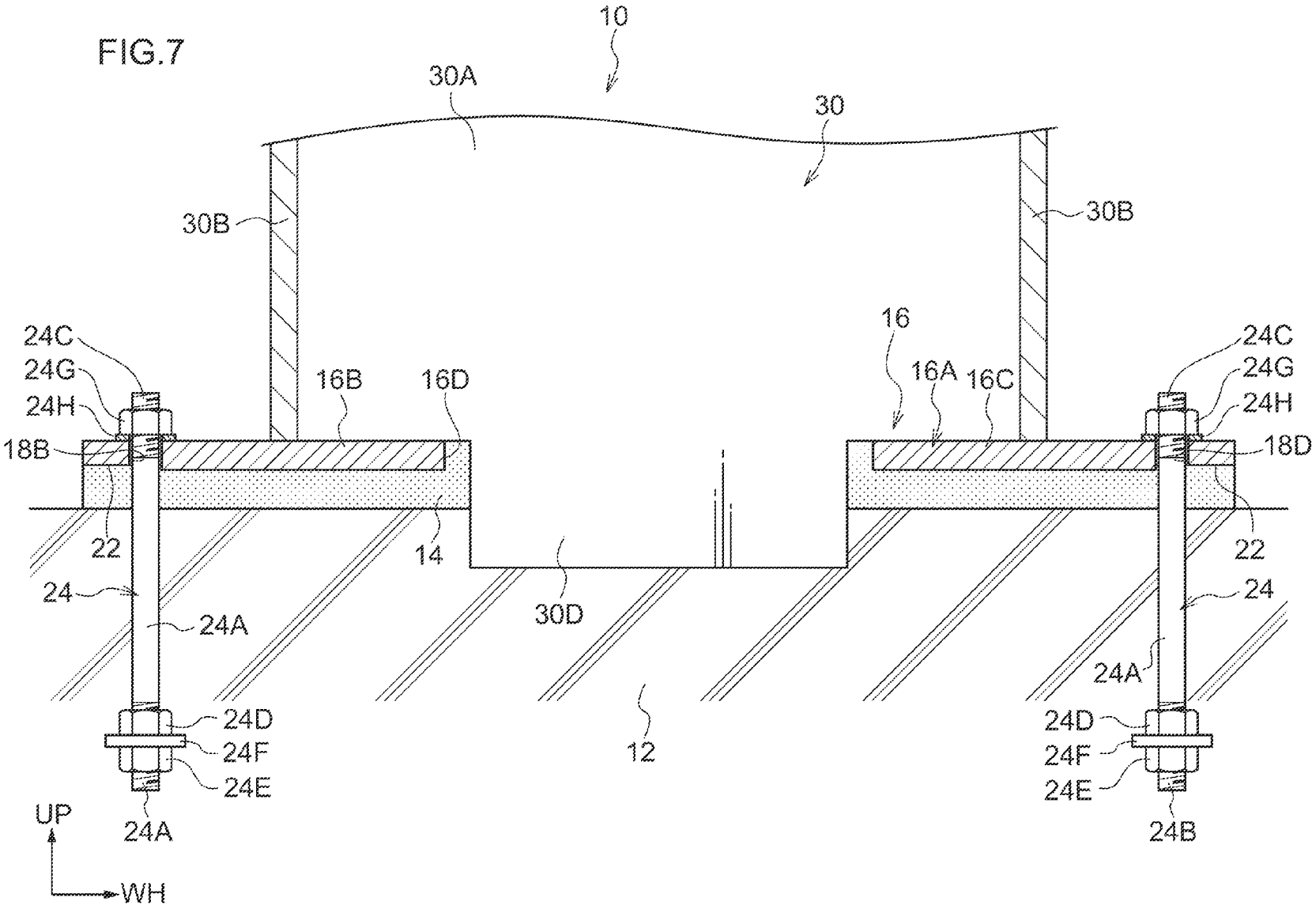
FIG. 7 is a cross-section of a column structure according to a fourth exemplary embodiment of the present invention, corresponding to FIG. 1.

Explanation next follows regarding a column structure according to a fourth exemplary embodiment of the present invention, with reference to FIG. 7.

Column Structure Configuration

As illustrated in FIG. 7, a column structure 10 according to the present exemplary embodiment is provided with a shear resistance member 30D that extends further downward compared to the shear resistance member 30C of the column structure 10 according to the first exemplary embodiment. The shear resistance member 30D is provided so as to pierce through the mortar 14, and extend as far as into the foundation 12, and as a result is buried in the mortar 14 and in the foundation 12.

Operation and Advantageous Effects of the Fourth Exemplary Embodiment

In the column structure 10 according to the present exemplary embodiment, the shear resistance member 30D is buried in the foundation 12, and this thereby enables the shear resistance of the steel column 30 to be increased with respect to the foundation 12 and the mortar 14, enabling the shear strength to be raised even further. In particular, since the strength of the foundation 12 is higher than that of the mortar 14, providing the shear resistance member 30D in the foundation 12 significantly increases the shear strength.

Fifth Exemplary Embodiment

Figure 8:
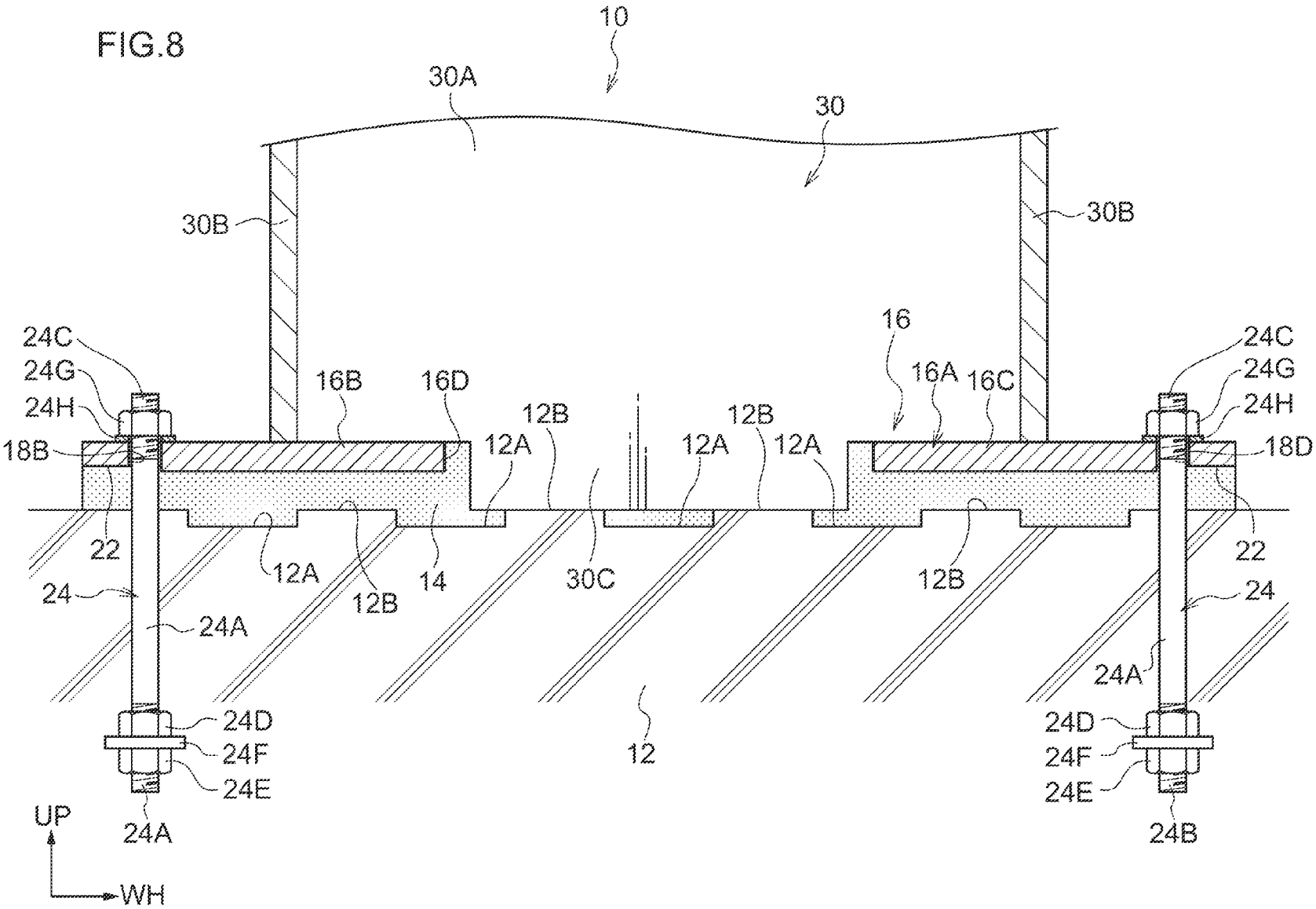
FIG. 8 is a cross-section of a column structure according to a fifth exemplary embodiment of the present invention, corresponding to FIG. 1.

Explanation next follows regarding a column structure according to a fifth exemplary embodiment of the present invention, with reference to FIG. 8.

Column Structure Configuration

As illustrated in FIG. 8, in the column structure 10 according to the present exemplary embodiment, indentation and protrusion portions, including indentation portions 12A and protrusion portions 12B are provided on the upper face of the foundation 12 of the column structure 10 of the first exemplary embodiment, and these indentation and protrusion portions are then buried in the mortar 14. Plural of the indentation portions 12A are placed at specific intervals in the horizontal direction, and the protrusion portions 12B are placed between the indentation portions 12A. Although there is no plan view provided, the indentation portions 12A may be arrayed in matrix pattern, or chessboard pattern, with the protrusion portions 12B provided at the outline locations of the indentation portions 12A. Alternatively, the protrusion portions 12B may arrayed in a matrix pattern, or chessboard pattern, with the indentation portions 12A provide at the outline locations of the protrusion portions 12B. Moreover, in order to raise the shear strength in a particular direction, such as the width direction of the web 30A, the indentation portions 12A and the protrusion portions 12B may be formed in a pattern of stripes having a length direction oriented in the width direction of the flanges 30B.

Operation and Advantageous Effects of the Fifth Exemplary Embodiment

In the column structure 10 according to the present exemplary embodiment, the indentation and protrusion portions are provided to the upper face portion of the foundation 12, and the mortar 14 is provided so as to cover the indentation and protrusion portions of the upper face portion of the foundation 12. Shear stress is thereby efficiently suppressed from occurring at the interface between the foundation 12 and the mortar 14. This thereby enables the shear strength of the column structure 10 to be raised even further.

Sixth Exemplary Embodiment

Figure 9:
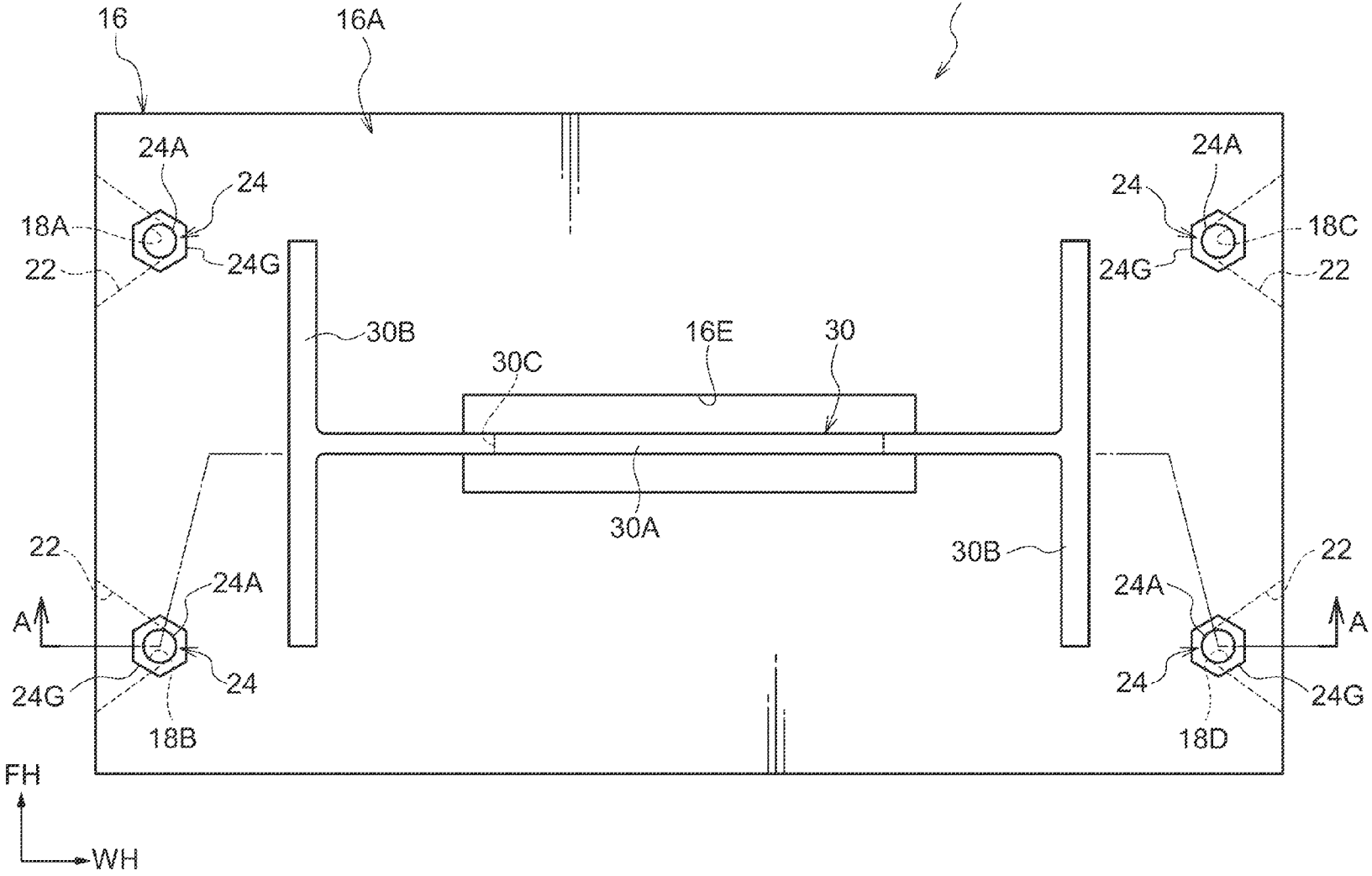
FIG. 9 is a plan view of a column structure according to the sixth exemplary embodiment, corresponding to FIG. 2.

Explanation next follows regarding a column structure according to a sixth exemplary embodiment of the present invention, with reference to FIG. 9.

Column Structure Configuration

As illustrated in FIG. 9, in the column structure 10 according to the present exemplary embodiment, the base member 16 is not divided into a first base member and a second base member, and instead the base member 16 is formed as a base body by a single sheet base plate 16A. A pass-through portion 16E is provided in the base plate 16A at a location where the web 30A is provided, piercing through from the front face to the back face of the base plate 16A. The pass-through portion 16E is a rectangular slit shape in plan view, oriented with its length direction along the width direction of the web 30A, and with its short direction along the width direction of the flanges 30B. A shear resistance member 30C provided to a lower portion of the web 30A goes through the pass-through portion 16E, and is buried in the mortar 14.

Note that the shear resistance member 30C may be configured as the shear resistance member 30D illustrated in FIG. 7, with the shear resistance member 30D buried in the mortar 14 and in the foundation 12.

Operation and Advantageous Effects of the Sixth Exemplary Embodiment

In the column structure 10 according to the present exemplary embodiment, the pass-through portion 16E is provided to the base member 16, enabling the shear resistance member 30C (or the shear resistance member 30D) to go easily through the pass-through portion 16E so as to be provided buried in at least the mortar 14.

Other Exemplary Embodiments

The present invention is not limited to the above exemplary embodiment, and various modifications are possible within a range not departing from the scope of the present invention. For example, in the above exemplary embodiments, there are two fixing portions and two anchor portions provided to base plate(s), serving as the base member, at the opposite side of the flanges to the web side. There is, however, no limitation in present invention to the number of fixing portions and anchor portions provided, and, for example, three or more fixing portions and three or more anchor portions may be provided. Moreover, in the present exemplary embodiment, fixing portions and anchor portions may also be provided to the base plate on the web side of the flanges.

The present invention may be configured as a column structure in which a steel column formed from I-section steel serves as a column member joined to the upper side of a base member.

The invention claimed is:

1. A column structure placed on a foundation, the column structure comprising:

a column member having a web and flanges that are integrally provided at both sides, in a width direction, of the web;

a base member having an upper side that is joined to the column member;

an anchor member having a lower end side that is fixed to the foundation, and an upper end side to which the base member is fixed;

a fixing member that is disposed between the foundation and the base member; and a shear resistance member that is disposed at a lower portion of the web, that extends past the base member at least into the fixing member, and that increases the shear resistance of the column member at least with respect to the fixing member.

2. The column structure of claim 1, wherein:

the shear resistance member is integrally formed with the lower portion of the web with the length direction of the shear resistance member oriented in the width direction of the web.

3. The column structure of claim 1, wherein:

second shear resistance members are joined to the lower portion of the web, and are buried at least in the fixing member.

4. The column structure of claim 3, wherein:

the second shear resistance members comprise plates that are joined to the lower portion of the web, and that have a length direction oriented in the width direction of the flanges.

5. The column structure of claim 1, wherein:

the base member includes a first base member having a first upper side to which one of the flanges is joined, and a second base member that is separated from the first base member and that has a second upper side to which the other of the flanges is joined; and the shear resistance member is disposed between the first base member and the second base member.

6. The column structure of claim 1, wherein:

the shear resistance member is buried only in the fixing member.

7. The column structure of claim 6, wherein:

indentation and protrusion portions are provided on an upper face portion of the foundation, and the fixing member is provided so as to cover the indentation and protrusion portions of the upper face portion of the foundation.

8. The column structure of claim 1, wherein:

the shear resistance member is buried in the fixing member and in the foundation.

9. The column structure of claim 1, wherein:

a pass-through portion extends completely through from a surface of the upper side of the base member to a surface of a lower side of the base member, and the shear resistance member extends through the pass-through portion at least into the fixing member.

* * * * *